US005150970A

United States Patent [19]

Albarelli

[11] Patent Number: 5,150,970

[45] Date of Patent: Sep. 29, 1992

[54] OPEN MESH CARRYING BAG AND METHOD OF MAKING

[76] Inventor: Joseph M. Albarelli, 17 Denise Dr., Kinnelon, N.J. 07405

[21] Appl. No.: 763,553

[22] Filed: Sep. 23, 1991

[51] Int. Cl.[5] ..... B65D 30/06; B65D 33/28

[52] U.S. Cl. ..... 383/76; 383/75; 383/117; 493/225; 493/928

[58] Field of Search ..... 383/71, 72, 75, 76, 383/117, 6, 7, 17; 493/225, 928

[56] References Cited

U.S. PATENT DOCUMENTS

| | | | |
|---|---|---|---|
| 467,108 | 1/1892 | Cussen | 383/75 |
| 2,390,423 | 12/1945 | Carter | 383/117 X |
| 2,393,151 | 1/1946 | Debate | 383/117 X |
| 2,731,998 | 1/1956 | Harris, Jr. | 383/117 X |
| 2,832,116 | 4/1958 | Clevett et al. | 383/76 X |
| 3,425,472 | 2/1969 | Marino | 383/76 X |
| 3,920,180 | 11/1975 | Meier | 383/76 X |
| 4,932,790 | 6/1990 | Jordá | 383/76 X |

FOREIGN PATENT DOCUMENTS

| | | | |
|---|---|---|---|
| 525464 | 5/1956 | Belgium | 383/76 |
| 1208680 | 1/1966 | Fed. Rep. of Germany | 383/72 |
| 3300573 | 7/1983 | Fed. Rep. of Germany | 383/117 |
| 2461658 | 3/1981 | France | 383/17 |

*Primary Examiner*—Stephen Marcus
*Assistant Examiner*—Jes F. Pascua
*Attorney, Agent, or Firm*—Samuelson & Jacob

[57] ABSTRACT

An open mesh carrying bag having a drawstring closure is constructed of an open mesh material provided with a hem at the closure, the hem including a folded-over portion of the material overlapping a further portion of the material, the folded-over portion and the overlapped further portion being secured together in the hem by the drawstring of the drawstring closure, which drawstring is threaded through registered mesh openings in the folded-over portion and in the overlapped further portion to secure together the folded-over portion and the overlapped further portion and to serve as a carrying handle while enabling selective contraction and closing of the drawstring closure by drawing upon the drawstring.

10 Claims, 1 Drawing Sheet

OPEN MESH CARRYING BAG AND METHOD OF MAKING

The present invention relates generally to carrying bags and pertains, more specifically, to an improved construction and method of construction for carrying bags made of an open mesh material and having a drawstring closure.

Open mesh carrying bags with drawstring closures have been popular for a very long time. A variety of constructions have been developed in an effort to manufacture these carrying bags more economically, while maintaining the structural integrity necessary for satisfactory performance. It has even been suggested that construction can be simplified by threading the drawstring through the openings provided by the interstices of the open mesh material, thereby eliminating the necessity for a stitched hem, and the concomitant stitching operation, to accommodate the drawstring. More recently, open mesh synthetic polymeric materials have been employed in the packaging of a wide variety of articles; however, adapting these more economical materials to a carrying bag with a drawstring closure has presented some problems, in the manufacturing process as well as in the performance of the completed structure, particularly where the open mesh material is a lightweight material having filaments of relatively small cross-sectional area and the drawstring also serves as a carrying handle for the bag.

The present invention provides an improvement which enables open mesh materials, and especially lightweight synthetic polymeric open mesh materials with filaments of relatively small cross-sectional area of the type heretofore used a packaging materials, to be employed in the manufacture of open mesh carrying bags with drawstring closures and carrying handles, and attains some of the advantages previously offered by a stitched hem at the closure of the bag, without requiring a separately stitched hem and the accompanying stitching operation. As such, the present invention exhibits several objects and advantages, some of which are summarized as follows: Enables the economical manufacture and use of open mesh carrying bags having a drawstring closure and carrying handle for a very wide variety of carrying requirements; provides an open mesh carrying bag construction of requisite strength and durability, even when made of lightweight open mesh synthetic polymeric materials having filaments of relatively small cross-sectional area for service in packaging items for display and sale as well as for subsequent service as a carrying bag; attains a drawstring closure and carrying handle of improved strength and durability, placed at a smoothly finished end of the carrying bag, without requiring a separately stitched hem and a concomitant separate stitching operation; successfully copes with the somewhat stiffer characteristics of the filaments of synthetic polymeric open mesh materials to construct a durable, smooth-edged closure in an open mesh drawstring closure carrying bag employing such materials; enables the manufacture of open mesh carrying bags having drawstring closures in large quantities of consistent high quality and exemplary performance.

The above objects and advantages, as well as further objects and advantages, are attained by the present invention which may be described briefly as an improvement in a carrying bag for articles of maximum predetermined dimensions, the carrying bag including: at least one side wall constructed of an open mesh material having mesh openings, the mesh openings all having dimensions in every direction smaller than the maximum predetermined dimensions of the articles to be carried, the side wall extending from a bottom end to a top end; bottom closure means; and top closure means for selectively closing the bag at the top end of the side wall, the improvement comprising: a hem at the top end of the side wall, the hem including a folded-over portion of the side wall folded back toward the bottom end so as to overlap a further portion of the side wall adjacent the top end and register at least some of the mesh openings in the folded-over portion of the side wall with counterpart mesh openings in the overlapped further portion of the side wall; and a drawstring threaded through at least some of the registered mesh openings such that the drawstring passes through both the folded-over portion and the overlapped further portion of the side wall, whereby the drawstring serves to secure together the folded-over portion and the overlapped further portion of the side wall to provide a carrying handle while enabling selective contraction and closing of the top end of the bag by drawing upon the drawstring. The present invention further includes a method for making the carrying bag, the method comprising: establishing a hem at the top end of the side wall by folding a portion of the side wall at the top end over an adjacent further portion of the side wall so that the folded-over portion overlaps the further portion of the side wall and at least some of the mesh openings in the folded-over portion are registered with corresponding mesh openings in the overlapped further portion of the side wall; and threading a drawstring through at least some of the registered mesh openings such that the drawstring passe through both the folded-over portion and the overlapped further portion of the side wall, whereby the drawstring serves to secure together the folded-over portion and the overlapped further portion of the side wall to provide a carrying handle while enabling selective contraction and closing of the top end of the bag by drawing upon the drawstring.

The invention will be understood more fully, while still further objects and advantages will become apparent, in the following detailed description of preferred embodiments of the invention illustrated in the accompanying drawing, in which.

Figure 1:
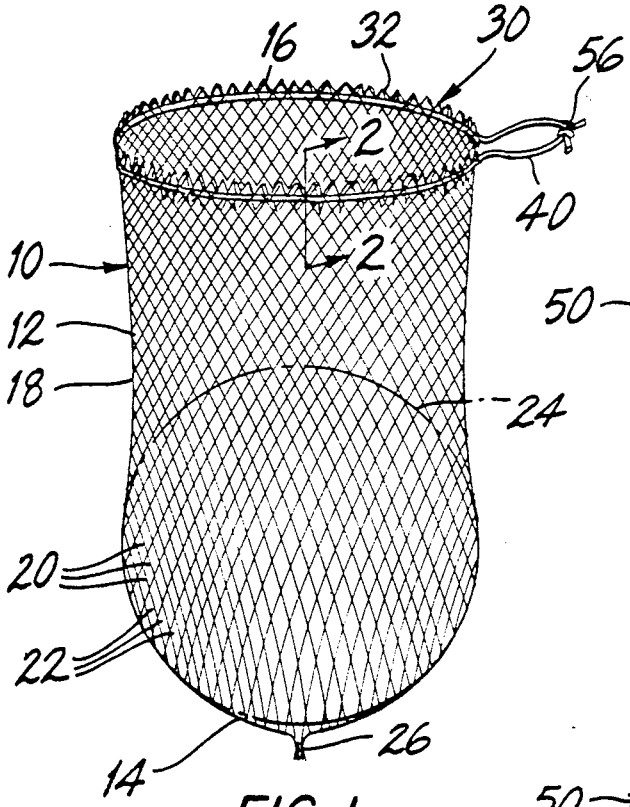
FIG. 1 is a pictorial view of an open mesh drawstring carrying bag constructed in accordance with the invention and in use.

Referring now to the drawing, and especially to FIG. 1 thereof, an open mesh carrying bag constructed in accordance with the invention is illustrated generally at 10 and is seen to include a generally tubular member 12 having a closed bottom 14, an open top 16 and a side wall 18 extending from the top 16 to the bottom 14. The preferred material for the member 12 is an open mesh synthetic polymeric material, such as a high-density polyethylene mesh material available commercially under the trademark VEXAR, usually used as a packaging material. The material is thermoplastic and has filaments 20 of relatively small cross-sectional area, the filaments 20 having a diameter of about 0.007 to 0.008 inch. Mesh openings 22 are provided by the interstices of the open mesh material of the member 12. The maximum dimensions of the openings 22 in all directions are considerably smaller than the minimum predetermined dimensions of the articles to be carried in the bag 10, one such article being a toy ball, illustrated in phantom at 24.

Figure 2:
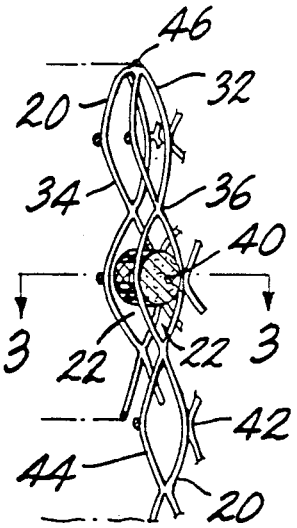
FIG. 2 is an enlarged fragmentary cross-sectional view taken along line 2—2 of FIG. 1.
Figure 3:
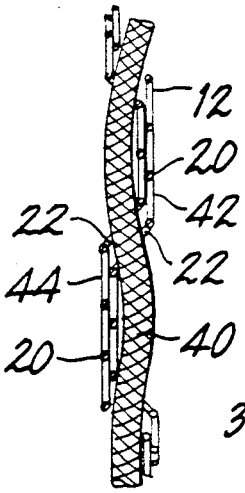
FIG. 3 is a cross-sectional view taken along line 3—3 of FIG. 2.

The bottom 14 is closed permanently by closure means in the form of a fused seal 26 at the bottom end of the member 12. The top 16 is shown open and is provided with a top closure in the form of a drawstring closure 30 which is selectively drawn closed and opened in a manner well known in drawstring closures. A hem 32 at the top 16, located at the top end of the side wall 18, is formed by a folded-over portion 34 of side wall 18, which folded-over portion 34 is folded back toward the bottom 14 so as to overlap a further portion 36 of the side wall 18 adjacent the top 16 and register at least some of the mesh openings 22 in the folded-over portion 34 with counterpart mesh openings 22 in the overlapped further portion 36, as best seen in FIGS. 2 and 3. The folded-over portion 34 preferably is short relative to the overall axial length of the bag 10 so that the hem 32 is relatively short. A drawstring 40 having a maximum diameter no greater than the corresponding maximum dimensions of the openings 22 is threaded through at least some of the registered openings 22 so that the drawstring 40 passes through both the folded-over portion 34 and the overlapped further portion 36 of the side wall 18. The bag 10 includes an exterior 42 and an interior 44, and the drawstring 40 is threaded alternately through registered openings 22 from the exterior 42 to the interior 44, and then through adjacent registered openings 22 from the interior 44 to the exterior 42. In this manner, the drawstring 40 serves to secure together the folded-over portion 34 and the overlapped portion 36 while enabling the selective contraction and closing of the top 16 by drawing upon the drawstring 40. Thus, the hem 32 is established without the necessity for a separate stitched construction and provides the bag 10 with a smooth edge 46 along the top 16 of the bag 10. The smooth edge 46 is a decided advantage, both aesthetically and from a tactile standpoint, especially in view of the relatively stiff nature of the filaments 20 of the synthetic polymeric material of the member 12. Additionally, the hem 32 provides added strength to the drawstring closure 30 so that the filaments 20 of relatively small cross-sectional area now are reinforced for exemplary service as an integral part of the drawstring closure 30. The double-walled arrangement provided by the folded-over portion 34 and the overlapped further portion 36 of the hem 32 enables the material of member 12 to better withstand the forces imposed by using the drawstring 40 as a carrying handle, as well as a closure means, for the bag 10. Preferably, the folded-over portion 34 is folded toward the inside of the bag 10 to be juxtaposed with the interior 44 so that the somewhat prickly ends 48 presented by the severed ends of the relatively stiff filaments 20 are placed inside of the bag 10, where the ends 48 are less likely to snag upon surfaces which may come into contact with the exterior 42 of the bag 10 during service. The ability to employ an open mesh material of the type ordinarily used for packaging enables bag 10 to serve the dual purpose of packaging items for display and sale, and subsequently containing items for carrying.

Figure 4:
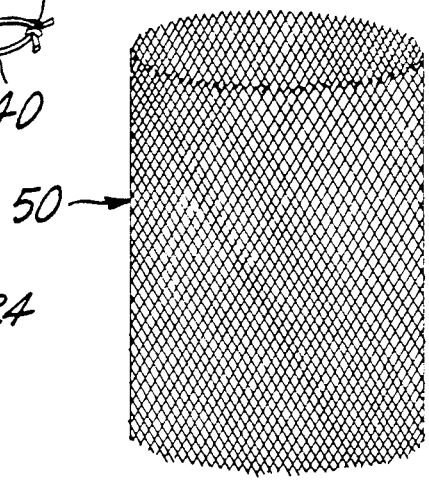
FIG. 4 is a somewhat diagrammatic illustration of a component part of the carrying bag as the bag is being manufactured by the method of the present invention.
Figure 5:
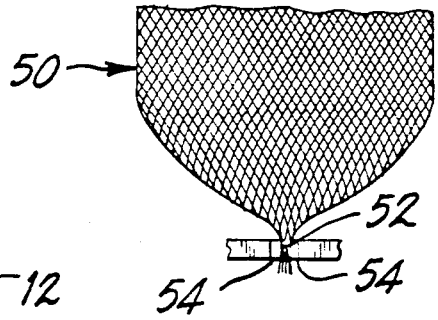
FIG. 5 is a fragmentary view of a portion of the component part illustrated in FIG. 4 and showing another operation in the method.
Figure 6:
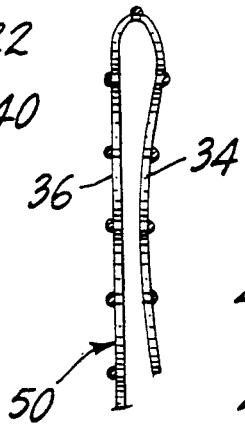
FIG. 6 is an enlarged fragmentary cross-sectional view illustrating still another operation in the method.
Figure 7:
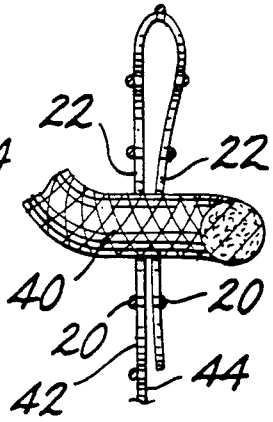
FIG. 7 is a fragmentary cross-sectional view similar to FIG. 6, but showing a further manufacturing operation.

Turning now to FIGS. 4 through 7, bag 10 is made by cutting a predetermined length 50 of tubular open mesh material, as illustrated in FIG. 4, from stock tubular thermoplastic synthetic polymeric open mesh material supplied in an indeterminate length. The bottom of the length 50 is closed permanently by gathering the material together into a relatively small area 52 and then fusing the material in the small area 52, as by pinching the small area 52 between heated dies 54, as seen in FIG. 5, until the material is fused. The folded-over portion 34 is established at the top of the length 50 and is folded over a relatively short distance toward the bottom of the length 50 to overlap the further portion 36, as illustrated in FIG. 6. Subsequently, the drawstring 40 is threaded through registered openings 22 in the folded-over portion 34 and the overlapped further portion 36, as seen in FIG. 7, alternately from the exterior 42 to the interior 44, and from the interior 44 to the exterior 42, through corresponding adjacent sets of registered mesh openings 22 around the perimeter of the bag 10, to complete the bag 10. The drawstring 40 is knotted at 56 (see FIG. 1) to capture the drawstring 40 in the bag 10 for use as a closure means and as a carrying handle for the bag 10.

It will be seen that the present invention attains the several objects and advantages summarized above, namely: Enables the economical manufacture and use of open mesh carrying bags having a drawstring closure for a very wide variety of carrying requirements; provides an open mesh carrying bag construction of requisite strength and durability, even when made of lightweight open mesh synthetic polymeric materials having filaments of relatively small cross-sectional area, for service in packaging items for display and sale as well as for subsequent service as a carrying bag; attains a drawstring closure and carrying handle of improved strength and durability, placed at a smoothly finished end of the carrying bag, without requiring a separately stitched hem and a concomitant separate stitching operation; successfully copes with the somewhat stiffer characteristics of the filaments of synthetic polymeric open mesh materials to construct a durable, smooth-edged closure in an open mesh drawstring closure carrying bag employing such materials; enables the manufacture of open mesh carrying bags having drawstring closures in large quantities of consistent high quality and exemplary performance.

It is to be understood that the above detailed description of preferred embodiments of the invention are provided by way of example only. Various details of design, construction and procedure may be modified without departing from the true spirit and scope of the invention as set forth in the appended claims.

The embodiments of the invention in which an exclusive property or privilege is claimed are defined as follows:

1. In a carrying bag for articles of maximum predetermined dimensions, the carrying bag including:

at least one side wall constructed of an open mesh material having mesh openings, the mesh openings all having dimensions in every direction smaller than the maximum predetermined dimensions of the articles to be carried, the side wall extending from a bottom end to a top end;

bottom closure means; and top closure means for selectively closing the bag at the top end of the side wall;

an improvement in the top closure means, the improvement comprising:

a hem at the top end of the side wall, the hem including a folded-over portion of the side wall folded back toward the bottom end so as to overlap a further portion of the side wall adjacent the top end and register at least some of the mesh openings in the folded-over portion of the side wall with counterpart mesh openings in the overlapped further portion of the side wall; and a drawstring threaded through at least some of the registered mesh openings such that the drawstring passes through both the folded-over portion and the overlapped further portion of the side wall to secure together the folded-over portion and the overlapped further portion of the side wall without the necessity for additional securing means and provide a carrying handle while enabling selective contraction and closing of the top end of the bag by drawing upon the drawstring.

2. The improvement of claim 1 wherein the maximum diameter of the drawstring in no more than the corresponding maximum diameter of the mesh openings.

3. The improvement of claim 1 wherein the side wall of the bag comprises a tubular member of open mesh material.

4. The improvement of claim 1 wherein the open mesh material is a synthetic polymeric material and includes filaments of relatively small cross-sectional area.

5. The improvement of claim 4 wherein the synthetic polymeric material is a thermoplastic material and the bottom closure means includes a fused portion of the open mesh material, the fused portion permanently closing the bottom of the bag.

6. The improvement of claim 1 wherein the bag includes an exterior and an interior, and the drawstring is threaded alternately through corresponding registered mesh openings in the folded-over portion and in the overlapped further portion from the exterior to the interior and then threaded through adjacent corresponding registered mesh openings in the folded-over portion and in the overlapped further portion from the interior to the exterior.

7. The improvement of claim 1 wherein the bag has an axial length between the top end and the bottom end of the side wall and the axial extent of the hem from the top end of the side wall toward the bottom end of the side wall is short relative to the axial length of the bag.

8. The method of making a carrying bag for articles of maximum predetermined dimensions, the carrying bag including:

at least one side wall constructed of an open mesh material having mesh openings, the mesh openings all having dimensions in every direction smaller than the maximum predetermined dimensions of the articles to be carried, the side wall extending from a bottom end to a top end:

bottom closure means; and top closure means for selectively closing the bag at the top end of the side wall;

the method comprising:

establishing a hem at the top end of the side wall by folding a portion of the side wall at the top end over an adjacent further portion of the side wall so that the folded-over portion overlaps the further portion of the side wall and at least some of the mesh openings in the folded-over portion are registered with corresponding mesh openings in the overlapped further portion of the side wall; and threading a drawstring through at least some of the registered mesh openings such that the drawstring passes through both the folded-over portion and the overlapped further portion of the side wall to secure together the folded-over portion and the overlapped further portion of the side wall without the necessity for additional securing means and provide a carrying handle while enabling selective contraction and closing of the top end of the bag by drawing upon the drawstring.

9. The invention of claim 8 wherein the bag includes an exterior and an interior, and the drawstring is threaded alternately through corresponding registered mesh openings in the folded-over portion and in the overlapped further portion from the exterior to the interior and then threaded through adjacent corresponding registered mesh openings in the folded-over portion and in the overlapped further portion from the interior to the exterior.

10. The invention of claim 8 wherein the bag has an axial length between the top end and the bottom end of the side wall and the axial extent of the hem from the top end of the side wall toward the bottom end of the side wall is short relative to the axial length of the bag.

* * * * *